US005127878A

United States Patent [19]

Meckler

[11] Patent Number: 5,127,878

[45] Date of Patent: Jul. 7, 1992

[54] MIXING BOX

[75] Inventor: Gershon Meckler, 725 Campbell Way, Herndon, Va. 22070

[73] Assignees: Camp Dresser & McKee, Boston, Mass.; Gershon Meckler, Herndon, Va.; John C. Purdue, Toledo, Ohio

[21] Appl. No.: 742,545

[22] Filed: Aug. 8, 1991

Related U.S. Application Data

[60] Continuation of Ser. No. 503,430, Apr. 2, 1990, abandoned, which is a continuation of Ser. No. 300,127, Jan. 23, 1989, Pat. No. 4,913,036, which is a division of Ser. No. 19,149, Feb. 26, 1987, Pat. No. 4,858,519, which is a continuation of Ser. No. 314,872, Oct. 26, 1981, Pat. No. 4,657,178, which is a continuation-in-part of Ser. No. 184,282, Sep. 5, 1980, abandoned.

[51] Int. Cl.[5] ..... F24F 13/04

[52] U.S. Cl. ..... 454/264; 454/269

[58] Field of Search ..... 454/261, 263, 264, 265, 454/266, 269

[56] References Cited

U.S. PATENT DOCUMENTS 3,378,198 4/1968 Von Otto ..... 58/38.9

4,657,178 10/1981 Meckler ..... 236/13

*Primary Examiner*—William E. Topolcai

*Attorney, Agent, or Firm*—John C. Purdue; David C. Purdue

[57] ABSTRACT

An improved mixing box is disclosed. The mixing box comprises an inlet end, an outlet end, a substantially closed first passage to which primary air flows from a primary air inlet and then through induction means and to and from the outlet end. The induction means are positioned intermediate the inlet and outlet ends and are operable, when primary air flows through the passage, to induce a flow of air through a first opening for mixture with primary air and delivery therewith through the outlet end. The mixing box also comprises means for controlling the rate of flow of primary air and a fan operable to induce a flow of air through a second opening and to deliver such air through the outlet end of the box. The improvement includes a closed second passage formed in the mixing box for the flow of air from the second opening to the suction side of the fan and a control operable to energize the fan when the primary air flow is below a control rate and to de-energize the fan when the primary air flow is above the control rate. Additionally, the primary air inlet can open into the closed second passage which communicates directly with the first passage and therethrough with the induction means and the outlet end of the mixing box, while the fan discharges into the first passage and therethrough into the induction means, and through the outlet end of the box.

23 Claims, 5 Drawing Sheets

MIXING BOX

REFERENCE TO RELATED APPLICATIONS

This is a continuation of application Ser. No. 503,430, filed Apr. 2, 1990, now abandoned, itself a continuation of application Ser. No. 300,127 filed Jan. 23, 1989, now U.S. Pat. No. 4,913,036, itself a division of application Ser. No. 19,149 filed Feb. 26, 1987 now U.S. Pat. No. 4,858,519, itself a continuation of Ser. No. 314,872 filed Oct. 26, 1981, now U.S. Pat. No. 4,657,178, itself a continuation in part of application Ser. No. 184,282, filed Sept. 5, 1980, now abandoned.

FIELD OF THE INVENTION

This invention relates to a mixing box for an air conditioning system such as that shown in FIG. 1. The purpose of the system is to maintain a comfort condition, for example, a dry bulb temperature of about 75 degrees F., a suitable relative humidity and an air circulation rate not less than 0.4 cubic foot per minute per square foot of floor space. (CFM/SF), for occupants of a room 10. The system includes a duct 11 and a flexible line 12 through which primary, conditioned air from a riser 13, is circulated through a mixing box 14, and downwardly through a grill 15 into the room 10. The conditioned air flowing through the duct 11 into the mixing box 13 is typically at a temperature of about 50 degrees F., and must be delivered to the room 10 at a rate adequate to provide ventilation or fresh air. The minimum ventilation requirement varies, according to code, and might be, for example, 0.05 CFM/SF. Hence air must be supplied to the room 10 at the minimum circulation rate of 0.4 CFM/SF, and must contain the minimum ventilation, e.g., of 0.05 CFM/SF of primary air. Where a single mixing box 14 serves a room 10, all of the required ventilation air must be supplied therethrough. However, when several mixing boxes serve a single room or zone, some of the boxes can furnish all of the required ventilation air, at least under some conditions of operation, while the others merely recirculate air.

The mixing box 14 is positioned within a plenum 16 between a false ceiling 17 for the room 10 and a floor 18 of a room (not illustrated) thereabove. Air within the plenum 16 is heated, for example, to approximately 85 degrees F. by air rising from the room 10 through openings 19 in diffuser panels 20 of the lightling fixtures 21, and then through openings 22 in reflectors 23 of the lighting fixtures 12 and into the plenum 16. Air so circulated from the room 10 through the lighting fixtures 21 and into the plenum 16 is heated by the lights in the fixtures 21, which are shown as fluorescent tubes 24, so that the plenum 16 is a source for heated air. Additional, or alternate, heat sources, such as ducted hot air which might be at a temperature of 110 degrees F., can be positioned within the plenum 16 to augment the heat provided by the lights 24 in the fixtures 21.

The load in the room 10 can vary substantially from time to time depending on such factors as the occupancy of that room at a given time, the load imposed by the lights 24, computers copiers, and other equipment that may be used within the room 10, and the load that may be imposed thereon by solar energy. Accordingly, the mixing box 14 is required to maintain the desired comfort temperature of 75 degrees F. notwithstanding variations in the air conditioning load which occur from time for the indicated and other reasons.

DESCRIPTION OF THE PRIOR ART

Numerous mixing boxes of the induction type have been suggested. Examples of such mixing boxes are disclosed in U.S. Pat. Nos. 3,114,505, 3,390,720, 3,516,606, 3,583,477, 3,604,625, 3,610,522, 3,611,908, 3,823,870, 3,883,071, 3,929,285 and 4,084,389. In some such boxes, for example, the rate at which primary conditioned air is delivered to the mixing box 14 can be varied, with a compensating variation in the rate at which a flow of air, for example from the plenum 16 and/or from the room 10, is induced into the mixing box for mixture with the primary air, so that a mixture of supply air flows from the box at a substantially constant rate not less than the minimum circulation rate, but at a temperature which varies depending upon the proportions of primary conditioned air and induced air in the mixture. It has further been suggested that primary conditioned air can be by-passed around the induction portion of a mixing box to provide a maximum flow of primary conditioned air, with no induction for times of peak load on an air conditioning system.

U.S. Pat. No. 3,883,071 discloses a mixing box which receives and delivers to the room primary conditioned air at a rate which is varied between a maximum, not less than the minimum circulation rate, and a predetermined lesser rate, the minimum ventilation requirement, as the air conditioning load on the room 10 varies between a maximum and an intermediate load. The apparatus includes an induction nozzle for inducing a flow of air from the plenum 16 and/or from the room 10, for mixture with primary conditioned air; the resulting mixture is delivered as supply air.

U.S. Pat. Nos. 3,929,285 and 4,084,389 both disclose mixing boxes which use a continuously operating fan, positioned downstream from the mixing region, rather than an induction nozzle, to induce air flow by drawing supply air from the mixing region for delivery to the room 10 at a constant rate not less than the minumum circulation rate. U.S. Pat. No. 3,929,285 also discloses apparatus wherein the rate at which primary conditioned air is delivered to the room 10 is varied between a maximum, not less than the minimum circulation rate, and a predetermined lesser rate, the minimum ventilation requirement, as the air conditioning load on the room 10 varies between a maximum and an intermediate load. When the air conditioning load on the room 10 is below the intermediate load, primary conditioned air continues to be delivered at the predetermined lesser rate while an induced flow from the plenum 16 and/or room 10 includes heated air, as required, for temperature control.

BRIEF DESCRIPTION OF THE INVENTION

The instant invention is based upon the discovery of improved apparatus for room or zone control of temperature in an air conditioning system. The apparatus is different from the mixing boxes of U.S. Pat. Nos. 3,929,285 and 4,084,389 in that a fan is positioned upstream from the mixing region and used only intermittently to force a flow a flow of secondary air from the plenum for ultimate mixing with primary air and delivery therewith to the room 10, as required. Appratus is also provided wherein primary conditioned air is delivered to the room 10 at a rate which is varied between a maximum and a predetermined lesser rate as the air conditioning load on the room 10 varies between a maximum and a minimum load. At high loads, nozzles are used so that the primary air induces a flow of secondary room air; at lower loads, a fan is used to force a flow of secondary plenum air. In both cases, a mixture of primary and secondary air is delivered to the room 10. When cooling is not required, the apparatus continues to deliver primary air at the predetermined lesser rate while the rate at which secondary plenum air is forced to flow is varied, as required, for temperature control.

OBJECTS OF THE INVENTION

It is an object of the invention to provide an improved mixing box of the induction type which includes a fan to force a flow of secondary air from a plenum for ultimate mixing with primary, conditioned air and delivery therewith to a room.

It is a further object of the invention to provide an improved mixing box of the type described above, wherein the fan is used only intermittently to force of secondary air fromt he plenum.

DETAILED DESCRIPTION OF THE INVENTION

Figure 2:
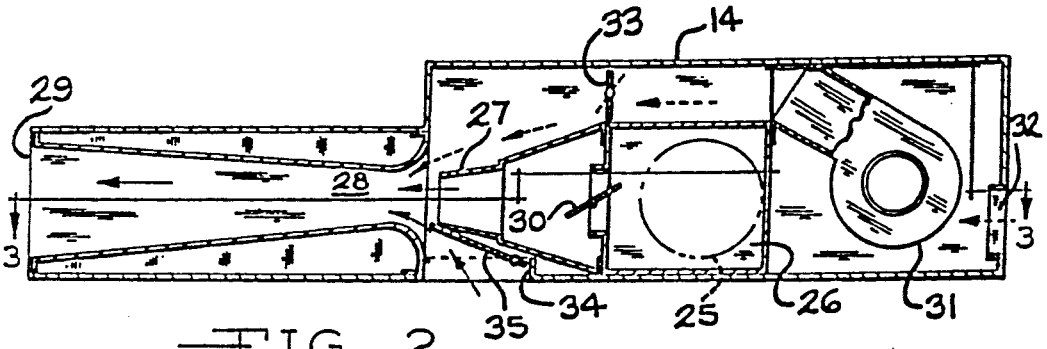
FIG. 2 is a vertical sectional view with part broken away to show details of the construction, of a mixing box according to the invention.
Figure 3:
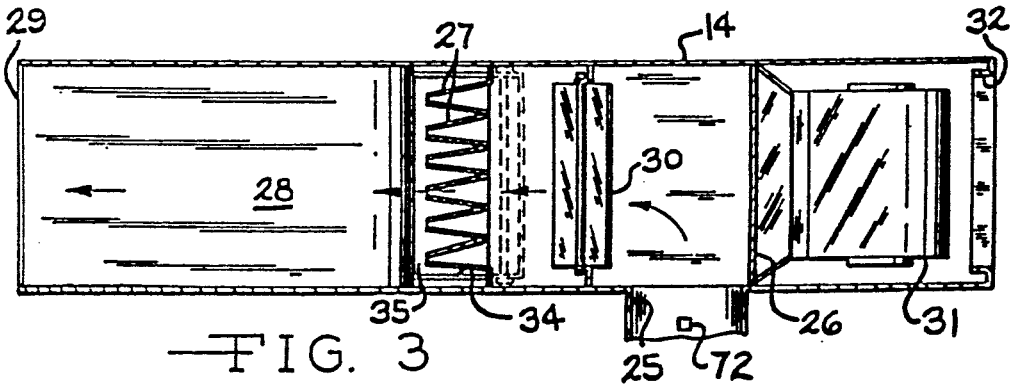
FIG. 3 is a horizontal sectional vie wof the mixing box of FIG. 2 taken along the line 3—3.

Referring in more detail to the drawing, and, in particular to FIGS. 2 and 3, primary conditioned air enters the mixing box 14 through and inlet 25 flowing into an induction box 26 at a rate which varies between approximately 0.5 and 0.05 CFM/SF. The conditioned air then flows through induction nozzles 27 and a mixing region 28 to a supply air outlet 29 at a rate which depends upon the setting of a primary damper 30 contained within the induction box 26. Secondary air, when required, is drawn by a fan 31 into the mixing box 14 through an inlet 32 and forced around the induction box 26 through a damper 33 and the mixing region 28 to the supply air outlet 29.

When the air conditioning load on the room 10 (FIG. 10) served by the mixing box 14 is high, the primary damper 30 (FIGS. 2 and 3) is modulated as required to vary the amount of primary conditioned air flowing through the supply outlet 29 to maintain a desired comfort condition, e.g., room air at a temperature of about 75 degrees F. circulated at a rate not less than 0.4 CFM/SF. The flow of primary conditioned air through the nozzles 27 not only tends to induce a corresponding flow of secondary air through an inlet 34 to open a damper 35, but also causes a back pressure tending to close the damper 33, as shown. For example, when the air conditioning load is at a maximum, the primary damper 30 is modulated to a fully open position enabling 0.5 CFM/SF of primary conditioned air (50 degrees F.) to be mixed with 0.5 CFM/SF of induced room air (75 degrees F.) so that the mixing box 14 delivers 1.0 CFM/SF of supply air at a temperature of about 62.5 degrees F.

As the primary damper 30 is closed to reduce the rate at which primary, conditioned air flows athrough the inlet 25 and, consequently, through the induction nozzles 27, a rate of flow is reached at which the primary air becomes comparatively ineffective at inducing a flow of secondary air through the inlet 34. The fan 31 prevents an undesirable loss of circulated air when the primary air flow is low, being energized whenever primary air is delivered at a rate lower than an intermediate rate, for example, less than 0.2 CFM/SF. The fan 31, when energized, causes a flow of secondary plenum air through the damper 33, which opens as indicated by a dashed line, to the mixing region 28. This flow of secondary plenum air causes a back pressure which closes the damper 35, as also indicated by a dashed line. When the fan is energized, and the damper 33 is set, so that 0.2 CFM/SF of secondary plenum air at 85 degrees F. is delivered by the fan 31 for mixing with 0.2 CFM/SF of primary, conditioned air in the mixing region 28, air is delivered from the supply outlet 29 at a rate of 0.4 CFM/SF and at a temperature of 67.5 degrees F. As the air conditioning load decreases still further, the primary damper 30 is throttled to decrease the flow of primary, conditiooned air for mixing with the forced, secondary plenum air. In order to maintain the mimimum circulation rate, the damper 33 is opened further, as required, to maintain 0.4 CFM/SF of supply air. For example, when the primary damper 30 is throttled to decrease the flow of primary air to a rate of slightly greater than 0.1 CFM/SF, the damper 33 is opened so that slightly less than 0.3 CFM/SF of secondary plenum air is mixed therewith. Accordingly, the mixture is delivered from the supply outlet 29 at a rate of 0.4 CFM/SF and at a temperature slightly less than 75 degrees F., the desired comfort temperature. The same result can also be accomplished with a variable-speed fan (not illustrated), rather than by controlling the damper 33.

The speed of the fan 31 can be increased, when necessary, above that which provides a flow of 0.3 CFM/SF. The speed of this fan 31 used to control temperature whenever primary air flowing at a rate of 0.05 CFM/SF causes the controlled temperature to decrease below that desired. Accordingly, when the primary damper 30 is throttled to provide primary air (50 degrees F.) at a rate of 0.05 CFM/SF and the fan 31 is operating to provide 0.35 CFM/SF of plenum air (85 degrees F.), the mixture flowing from the supply outlet 29 is at temperature slightly lower than 81 degrees F. If the control temperature continues to drop, the speed of the fan 31 is increased, up to a maximum of about 0.95 CFM/SF, at which point the mixture flowing from the supply outlet 29 has a temperature slightly below 84 degrees F.

Figure 4:
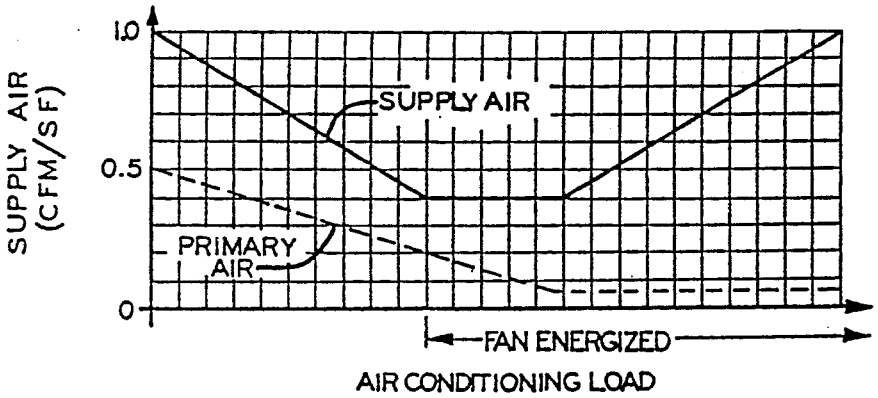
FIG. 4 is a graph showing air flow rates through the mixing box of FIGS. 2 and 3 when in operation.

The operation of the mixing box 14 of FIGS. 2 adn 3, insofar as air flows are concerned, is illustrated graphically in FIG. 4. As the air conditioning load varies between certain limits, the rate of flow of primary conditioned air is varied between 0.5 CFM/SF, and modulated, as required, to maintain control temperature. Whenever primary air flows through the nozzles 27 (FIGS. 2 and 3e at a rate between 0.5 and 0.2 CFM/SF, an equal flow of room air is induced through the inlet 34, so that the mixture of air delivered from the supply outlet 29 flows at a rate between 1.0 and 0.4 CFM/SF. When the primary air flow is between 0.2 and 0.05 CFM/SF, the fan 32 forces plenum air through the mixing region 28 at a rate between 0.2 and 0.35 CFM/SF, so that the total air delivered from the supply outlet 29 is constant at 0.4 CFM/SF. At still lower air conditioning loads the speed of the fan 31 varies so that plenum air is supplied at a rate from 0.35 to 0.95 CFM/SF, so that the total air flows from the supply outlet 29 at a rate between 0.4 and 1.0 CFM/SF.

Figure 1:
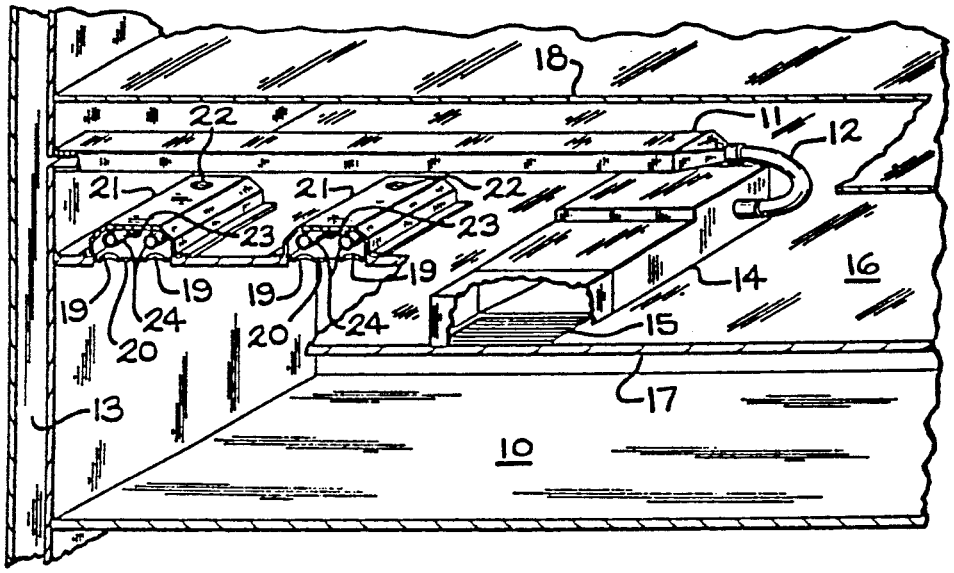
FIG. 1 is a partially schematic view in perspective, with parts broken away to shoe details of an air conditioning system which includes a mixing box accordingly to the invention.
Figure 5:
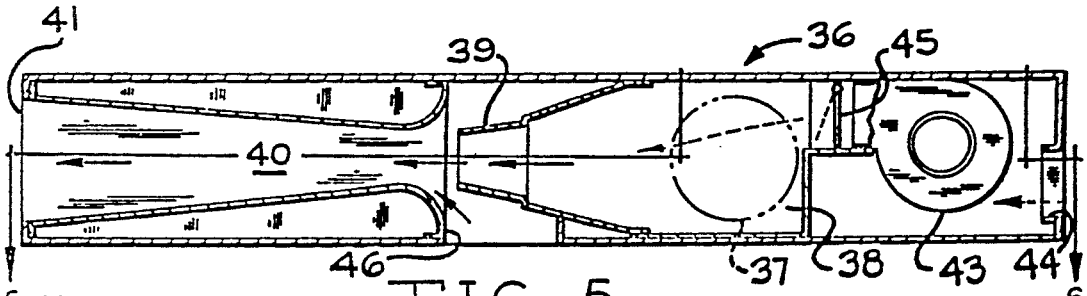
FIG. 5 is a vertical sectional view of another embodiment of a mixing box according to the invention.
Figure 6:
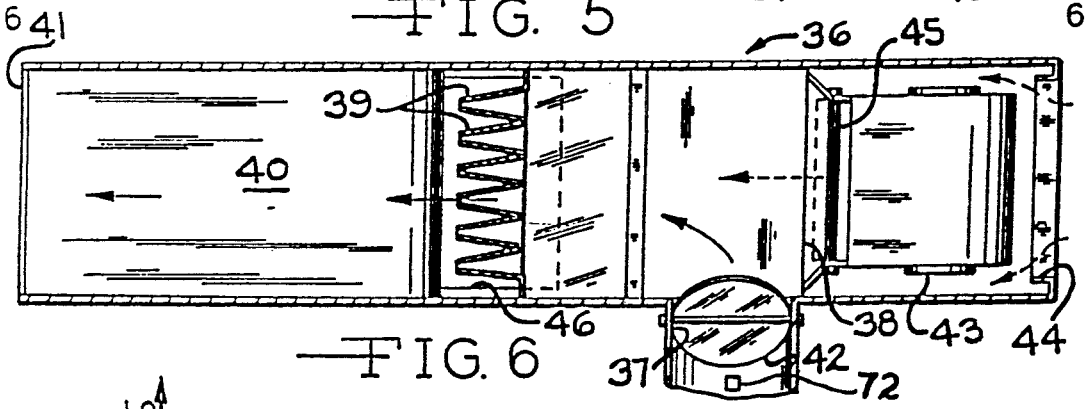
FIG. 6 is a horizontal sectional view of the mixing box of FIG. 5 taken along the line 6—6.

Another mixing box in accordance with the invention, interchangeable with the mixing box 14 shown in FIGS. 1–3, is indicated generally at 36 in FIGS. 5 and 6. Primary conditioned air enters the mixting box 36 through an inlet 37. from which it flows into an induction box 38 at a rate varying between 0.5 and 0.05 CFM/SF, the minimum ventilation requirement. The conditioned air flows from the induction box 38 through nozzles 39 and a mixing region 40 to a supply outlet 41. The rate of flow of primary air depends upon the setting of a primary damper 42. Secondary air can be drawn into the mixing box 36 by a fan 43, entering through an inlet 44. Such secondary air is forced through a back-draft damper 45, the induction box 38, the nozzles 39 and the mixing region 40 to the supply air outlet 41.

When the air conditioning load is high, the primary damper 42 is modulated to vary the rate of flow of primary conditioned air from the supply outlet 41 in order to maintain the desired comfort condition, i.e., room air at a dry bulb temperature of about 75 degrees F. Primary conditioned air flowing through the inlet 37 establishes a positive pressure within the induction box 38 which closes the damper 45. As a result, the primary air flows through the nozzles 39, inducing a corresponding flow of secondary air through an inlet 46. For example, the damper 42 can be modualted between a fully open position and a partially open position, enabling the flow of primary, conditioned air (50 degrees F.) at a rate between 0.5 and 0.2 CFM/SF. As the rate of primary air flow varies within the indicated limits, the secondary air (75 degrees F.) induced to flow through the inlet 46 also flows at a rate between 0.5 and 0.2 CFM/SF. Consequently, the mixture of induced air and primary conditioned air delivered through the supply outlet 41 varies from 1.0 CFM/SF to 0.4 CFM/SF at a substantially constant temperature of 62½ degrees F.

As the primary damper 42 is closed to throttle the rate at which primary, conditioned air flows through the inlet 37 and, consequently, through the induction nozzles 39, a rate of flow is reached at which the primary air becomes comparatively ineffective at inducing a flow of secondary air through the inlet 46. The fan 43 prevents an undesirable loss of circulated air when the primary air becomes ineffective to cause induction, being energized whenever primary air is delivered at a rate lower than an intermediate rate, for example, less than 0.2 CFM/SF. The fan 43, when energized, drawn secondary plenum air into the mixing box 36 through the opening 44 and forces the damper 45 to an open position, as indicated by a dashed line, to deliver that air into the induction box 38 for mixing with primary air. The mixture flows through the nozzles 39, inducing a flow of air through the inlet 46 into the mixing region 40, and, ultimately leaving the mixing box 36 through the supply outlet 41. The fan 43 can deliver air to the induction box 38 at a rate of 0.15 CFM/SF while the damper 42 is controlled to provide a flow of primary, conditioned air at a rate between 0.2 and 0.05 CFM/SF. Consequently, the mixture of primary, conditioned air and forced, secondary plenum air from the fan 43 flows through the induction nozzles 39 at a rate between 0.35 CFM/SF and 0.2 CFM/SF, inducing an equal flow through the inlet 46. Accordingly, the total air delivered from the supply outlet 41 varies from 0.7 to 0.4 CFM/SF as the flow of primary air varies from 0.2 to 0.05 CFM/SF.

The speed of the fan 43 can be increased, when necessary, above that which provides a flow of 0.15 CFM/SF, being used to control temperature whenever primary air flowing at a rate of 0.05 CFM/SF causes the controlled temperature to decrease below that desired. Accordingly, when the primary damper 42 is throttled to provide primary air (50 degrees F.) at a rate of 0.05 CFM/SF and the fan 43 is operating to provide 0.15 CFM/SF of plenum air (85 degrees F.), the mixture flowing through the induction nozzles 39 is at a temperature of about 75¼ degrees F. If the controlled temperature continues to drop, the speed of the fan 43 is increased, up to a maximum of about 0.45 CFM/SF, at which point the mixture flowing through the induction nozzles has a temperature of about 81½ degrees F.

Figure 7:
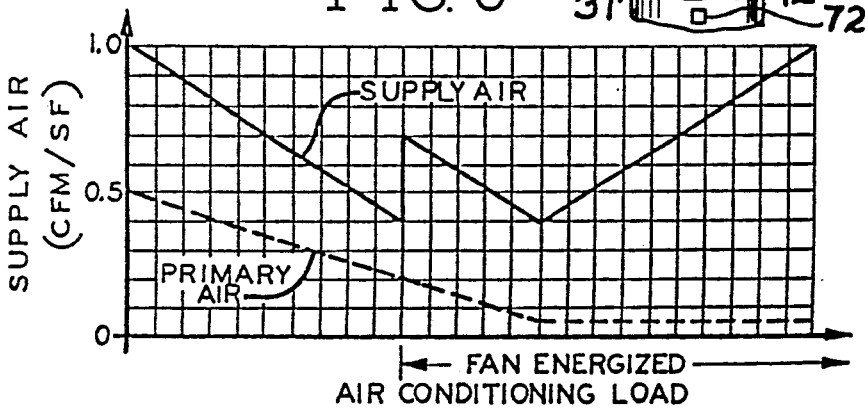
FIG. 7 is a graph showing the air flow rates through the mixing of FIGS. 5 and 6 when the operation.

The operation of the mixing box 36 of FIGS. 5 and 6, insofar as air flows are concerned, is shown graphically in FIG. 7. As the air conditioning load varies between certain limits, the rate of flow of primary conditioned air is varied between 0.5 CFM/SF and 0.05 CFM/SF, and modulated, as required, to maintain a control temperature. Whenever primary air flows through induction nozzles 39 (FIGS. 5 and 6) at a rate between 0.5 and 0.2 CFM/SF, and equal flow of room air is inducted through the inlet 46, so that the mixture of air delivered from the supply outlet 41 flows at a rate which varies from 1.0 to 0.4 CFM/SF. However, when primary air flows at a rate between 0.2 and 0.05 CFM/SF, the fan 43 forces plenum air into the induction box 38 at a constant rate of 0.15 CFM/SF for mixing with primary air. Consequently. the mixture flows through the induction nozzles 39 at a rate between 0.35 and 0.2 CFM/SF, so that the total air delivered from the supply outlet 41 flows at a rate which varies from 0.7 to 0.4 CFM/SF. At still lower air conditioning loads the speed of the fan 43 varies so that plenum air is forced into the induction box 38 at a rate from 0.15 to 0.45 CFM/SF for mixing with primary air. The mixture flows through the induction nozzles 39 at a rate varying from 0.2 to 0.5

CFM/SF, so that the total air flowing from the supply outlet 41 varies from 0.4 to 1.0 CFM/SF.

Figure 8:
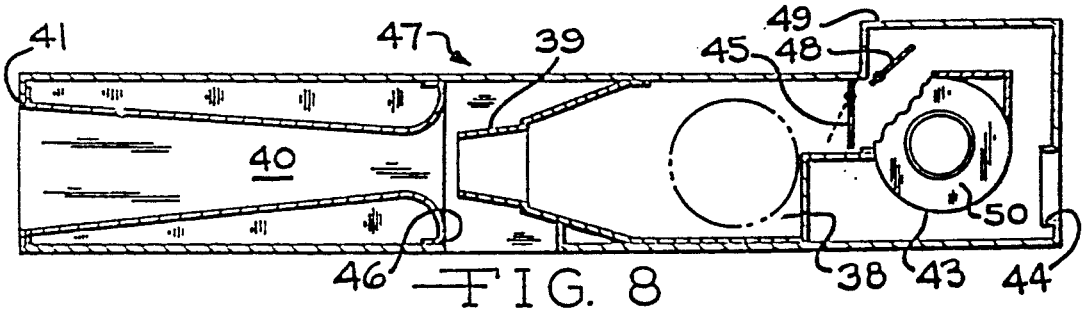
FIG. 8 is a vertical sectional view of still another embodiment of a mixing box according to the invention.

Still another mixing box in accordance with the invention, essentially the same as the mixing box 36 of FIGS. 5 and 6 where indicated by the use of like reference numerals, is indicated generally at 47 in FIG. 8. When primary air is delivered to the mixing box 47 at a rate between 0.2 and 0.05 CFM/SF, the fan 43 is energized and draws secondary plenum air through the inlet 44 at a rate of 0.2 CFM/SF. Such secondary air is forced through the damper 45 into the induction box 38, through a damper 48 into a duct 49 for circulation back to an input 50 of the fan 43, or both. When primary air is delivered at the intermediate rate of 0.2 CFM/SF, the damper 45 is closed by any suitable actuator (not illustrated), so that the secondary air is directed through the damper 48 and the duct 49 to be circulated at a rate of 0.2 CFM/SF. However, as the flow of primary air is throttled from 0.2 to 0.05 CFM/SF, the damper 45 is opened, as indicated by the dashed line, and the damper 48 is closed to force secondary plenum air into the induction box 38 at a rate increasing from zero to 0.15 CFM/SF, while air is circulated through the duct 49 at a rate decreasing from 0.2 to 0.05 CFM/SF. Hence, the mixture of primary air and forced secondary air flows through the induction nozzles 39 at a constant rate of 0.2 CFM/SF, inducing an equal flow through the inlet 46. Accordingly, a constant 0.4 CFM/SF air flow from the supply outlet 41 varies from 62½ degrees F. To slightly above 75 degrees F. as the flow of primary air varies from 0.2 to substantially 0.05 CFM/SF.

The speed of the fan 43 can be increased when necessary, above that which provides a flow of 0.2 CFM/SF, to control temperature whenever primary air flowing at a rate of 0.05 CFM/SF causes the controlled temperature to decrease below that desired. Accordingly, when primary air (50 degrees F.) is throttled to a rate of 0.05 CFM/SF and the fan 43 is operating to provide 0.15 CFM/SF of plenum air (85 degrees F.), the mixture flowing through the induction nozzles 39 is at a temperature of about 76½ degrees F. If the controlled temperature continues to drop, the damper 48 is closed and the speed of the fan 43 is increased up to a maximum of about 0.45 CFM/SF, at which point the mixture flowing through the induction nozzles 39 has a temperature of about 81½ degrees F.

Figure 9:
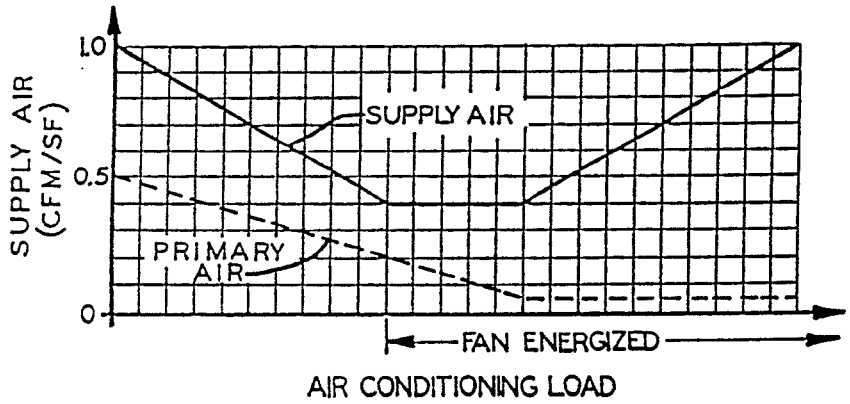
FIG. 9 is a graph showing air flow rates through the mixing box of FIG. 8 when in operation.

The operation of the mixing box 47 of FIG. 8, insofar as air flows are concerned, is shown graphically in FIG. 9. As the air conditioning load varies between certain limits, the rate of flow of primary, conditioned air is varied between 0.5 CFM/SF and 0.05 CFM/SF, and modulated, as required, to maintain a control temperature. Whenever primary air flows through the induction nozzles 39 (FIG. 8) at a rate between 0.5 and 0.2 CFM/SF, an equal flow air is inducted through the inlet 46, so that the mixture of air delivered from the supply outlet 41 flows at a rate which varies from 1.0 to 0.4 CFM/SF. However, when the primary air flows at a rate between 0.2 and 0.05 CFM/SF, the fan 43 forces plenum air into the induction box 38 at a rate increasing from zero to 0.15 CFM/SF for mixing with primary air. Consequently, the mixture flowing through the induction nozzles 39 stays constant at 0.2 CFM/SF, so that the total air delivered from the supply outlet 41 also stays constant at 0.4 CFM/SF. At still lower air conditioning loads the damper 48 is closed and the speed of the fan 43 varies so that plenum air is forced into the induction box 38 at a rate from 0.15 to 0.45 CFM/SF for mixing with primary air. The mixture flows through the induction nozzles 39 at a rate varying from 0.2 to 0.5 CFM/SF, so that the total air flowing from the supply outlet 41 varies from 0.4 to 1.0 CFM/SF.

Figure 10:
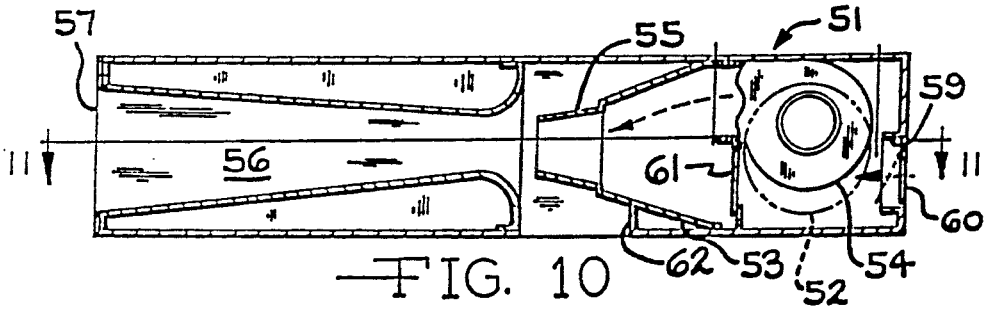
FIG. 10 is a vertical sectional vie wof yet another embodiment of a mixing box according to the invention.
Figure 11:
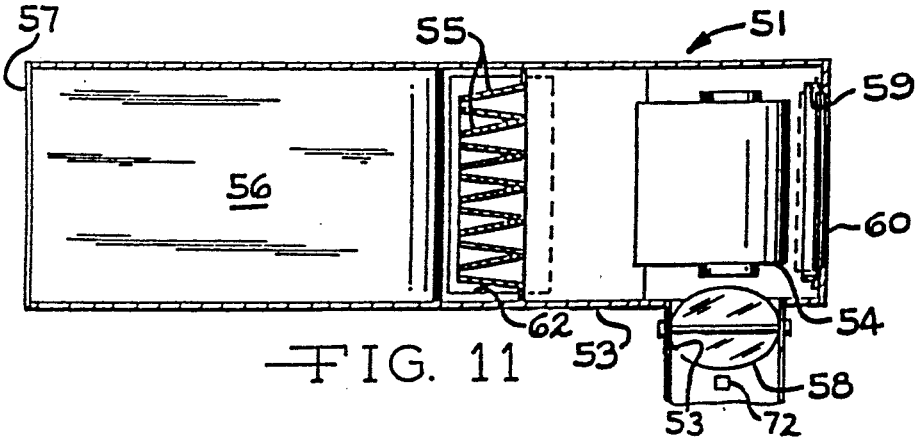
FIG. 11 is a horizontal sectional view of the mixing box of FIG. 10 taken along the line 11—11.

Still another mixing box in accordance with the invention, functionally interchangeable with the mixing box 47 shown in FIG. 8, is indicated generally at 51 in FIGS. 10 and 11. Primary, conditioned air enters the mixing box 51 through an inlet 52, flowing into an induction box 53 at a rate varying between 0.5 and 0.05 CFM/SF, the minimum ventilation requirement. The conditioned air, which flows through a fan 54 positioned within the induction box 53, flows from the induction box 53 through nozzles 55 and a mixing region 56 to a supply outlet 57. The rate of flow of primary air depends on the setting of a primay damper 58. The fan 54 can draw secondary plenum air into the induction box 53 through an inlet 59. Such secondary air is drawn through a back draft damper 60, being discharged through the induction box 53, the nozzles 55, and the mixing region 56 to the supply outlet 57.

When the air conditioning load is high, the primary damper 58 is modulated to vary the rate of flow of primary conditioned air from the supply outlet 57 in order to maintain the desired comfort condition, i.e., room air at a dry bulb temperature of about 75 degrees F. Primary conditioned air flowing through the inlet 52 creates a positive pressure within the induction box 53 which closes the back draft damper 60 and a second back draft damper 61. As a result,the primary air flows through the nozzles 55, inducing a corresponding flow of secondary air through an inlet 62. The damper 58 can be modulated, for example, between a fully open position and a partially open position, enabling the flow of primary, conditioned air (50 degress F.) at a rate between 0.5 and 0.2 CFM/SF. As the rate of primary air flow varies within the indicated limits, the second air (75 degrees F.) induced to flow through the inlet 62 also flows at a rate between 0.5 and 0.2 CFM/SF. Consequently, the mixture of inducted air and primary conditioned air delivered through the supply outlet 57 varies from 1.0 CFM/SF to 0.4 CFM/SF at a substantially constant temperature of 62½ degrees F.

As the primry damper is closed to throttle the flow of primary conditioned air through the inlet 52 and, consequently, through the induction nozzles 55, a rate of flow is reached at which the primary air becomes comparatively ineffective at inducing a flow of secondary air through the inlet 62. The fan 54 is then energerized to prevent an undesirable loss of circulated air by inducing a flow of air at a rate of 0.2 CFM/SF from its outlet, as indicated by a dashed arrow in FIG. 10. The fan 54 is energized while primary air is delivered at a rate varying from 0.05 to 0.2 CFM/SF, so that the air delivered to the nozzles 55 ranges from a mixture of 0.15 CFM/SF of plenum air with 0.05 CFM/SF of primary air to 0.2 CFM/SF of primary air. The mixture of primary air and plenum air is forced through the induction nozzles 55 at a constant rate of 0.2 CFM/SF, inducing an equal flow through the inlet 62. Accordingly, there is a constant 0.4 CFM/SF air flow from the supply outlet 57 which varies from 62½ degrees F. to slightly more than 75 degrees F. as the flow of primary air varies from 0.2 to 0.05 CFM/SF.

The speed of the fan 54 can be increased, when necessary, above that which provides a flow of 0.2 CFM/SF, to control temperature whenever primary air flowing at a rate of 0.05 CFM/SF causes the controlled temperature to decrease below that desired. The maximum speed for the fan 54 is about 0.5 CFM/SF, which causes a mixture of 0.05 CFM/SF primary air with 0.45 CFM/SF plenum air to flow through the induction nozzles 55 at a temperature of about 81½ degrees F. The operation of the mixing box 55 of FIGS. 10 and 11, in so far as air flows are concerned, is identical with that of box 47, FIG. 8, as shown graphically in FIG. 9.

Figure 12:
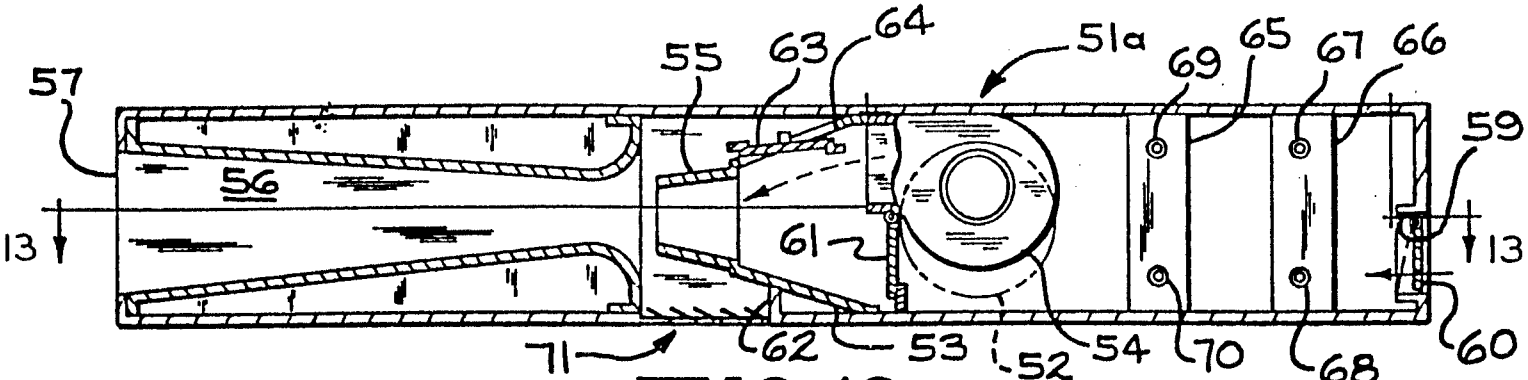
FIGS. 12 is a vertical sectional view of a further embodiment of a mixing box according to the invention.
Figure 13:
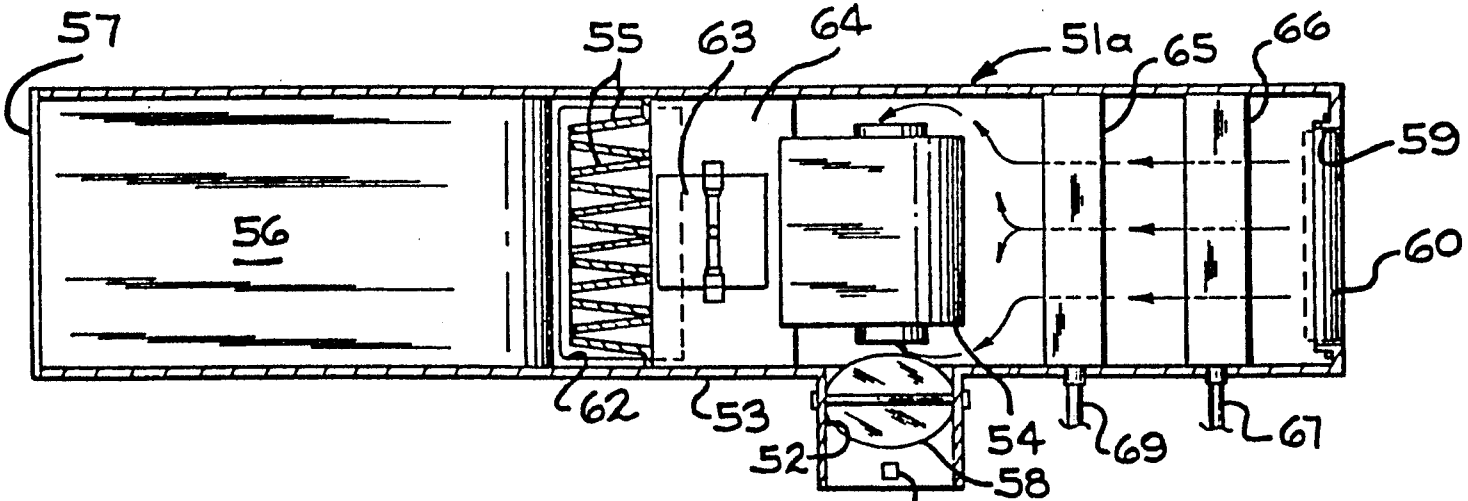
FIG. 13 is a horizontal sectional view of the mixing box of FIG. 12 taken along the line 13—13.

A modification of the mixing box 51 of FIGS. 10 and 11 is indicated generally at 51*a* in FIGS. 12 and 13. In most respects, as indicated by the use of the same reference numerals, the mixing box 51*a* is identical to the mixing box 51, differing in that there is a damper 63 in a wall 64 and there are heat exchange coils 65 and 66 between the inlet 59 and the suction side of the fan 54. The coil 66 can be connected, through an inlet 67 and an outlet 68, to a circulating system (not illustrated) from which a warm heat transfer fluid is delivered to the coil 66 when heating is required in the space served by the mixing box 51*a*. It is often desirable to accomplish heating, when required, with water at a comparatively low temperature, for example water which has been warmed by solar heat or in water cooled lighting fixtures. In such a situation, the damper 63 is advantageously opened so that air discharged from the fan 54 can bypass the nozzles 55. When the damper 63 is open, the air flow through the blower 54 and in contact with the coil 66 is at a maximum, and the maximum heating, for any given water temperature, is accomplished. In a similar manner, the coil 65 can be connected, through an inlet 69 and an outlet 70, to a circulating system (not illustrated) from which a cold heat transfer fluid is suplied to the coil 65.

The operation of the mixing boxes according to the present invention, as thus far described involves the use of comparatively cold primary, conditioned air, and the miture thereof with fan-induced and/or nozzles-induced air; the rate at which primary air is supplied is varied to compensate for changes in air conditioning load. This mode of operation is particularly advantageous from the standpoint of energy conversion, whenever the air conditioning load is heavy. Proportionately lower fan horsepower is required to circulate relatively cold air at a comparatively low rate in contrast with the circulation of higher temperature, primary air at a correspndingly higher rate to do the same air conditioning job. In addition, on many jobs, the circulation of comparatively, cold, primary air makes it possible to minimize the size of ducts, risers, headers and the like required to circulate conditioned and return air and, thereby, to minimize the volume of any given building that must be dedicated to ducts and the like.

It will be appreciated that, as the seasons changes, there are times in most building when it s necessary only to circulate ambient air from outside the building in order to maintain a desired comfort condition and that, often the ambient air will be at a temperature higher than that at which the air conditioning apparatus normally furnishes primary, conditioned air. For example, as previously indicated, 50° F. may be the normal dry bulb temperature for primary air, while ambient air may be available at, say, 55° to 60° F. The mixing box 51*a* of FIGS. 12 and 13 is admirably suited to supply low temperature, primary air when required, and higher temperature ambient air, when available. The higher temperature ambient air is merely furnished to the mixing box 51*a*through the inlet 52 at a rate of from 0.4 to 1 CFM/SF, depending upon the setting of the damper 58, as required to maintain a desired comfort condition. In this mode of operation, the flow of induced air through the inlet 62 is not desired; accordingly, the damper 63 is opened, either manually or automatically, to disable the induction nozzles 55; a back draft damper 71, in this mode of operation, prevents the flow of air through the inlet 62 from the interior of the box 51*a*.

The fans of the mixing boxes 14 (FIGS. 2 and 3), 36 (FIGS. 5 and 6) and 51 (FIGS. 10 and 11) can be controlled by a simple flow sensor 72 which can be, for example, a pitot tube, in the primary air inlet. Whenever the sensed flow is below the minimum (say 0.2 CFM/SF) which causes satisfactory induction, the fan is energized and, whenever the sensed flow is at least that minimum, the fan is de-energized. The fan of the mixing box 51*a* (FIGS. 12 and 13) can also be controlled in the manner just described unless ambient air at a high flow is being provided through the inlet 52, in which case the damper 63 is open. The fan 54 can be de-energized whenever the damper 63 is open.

Figure 14:
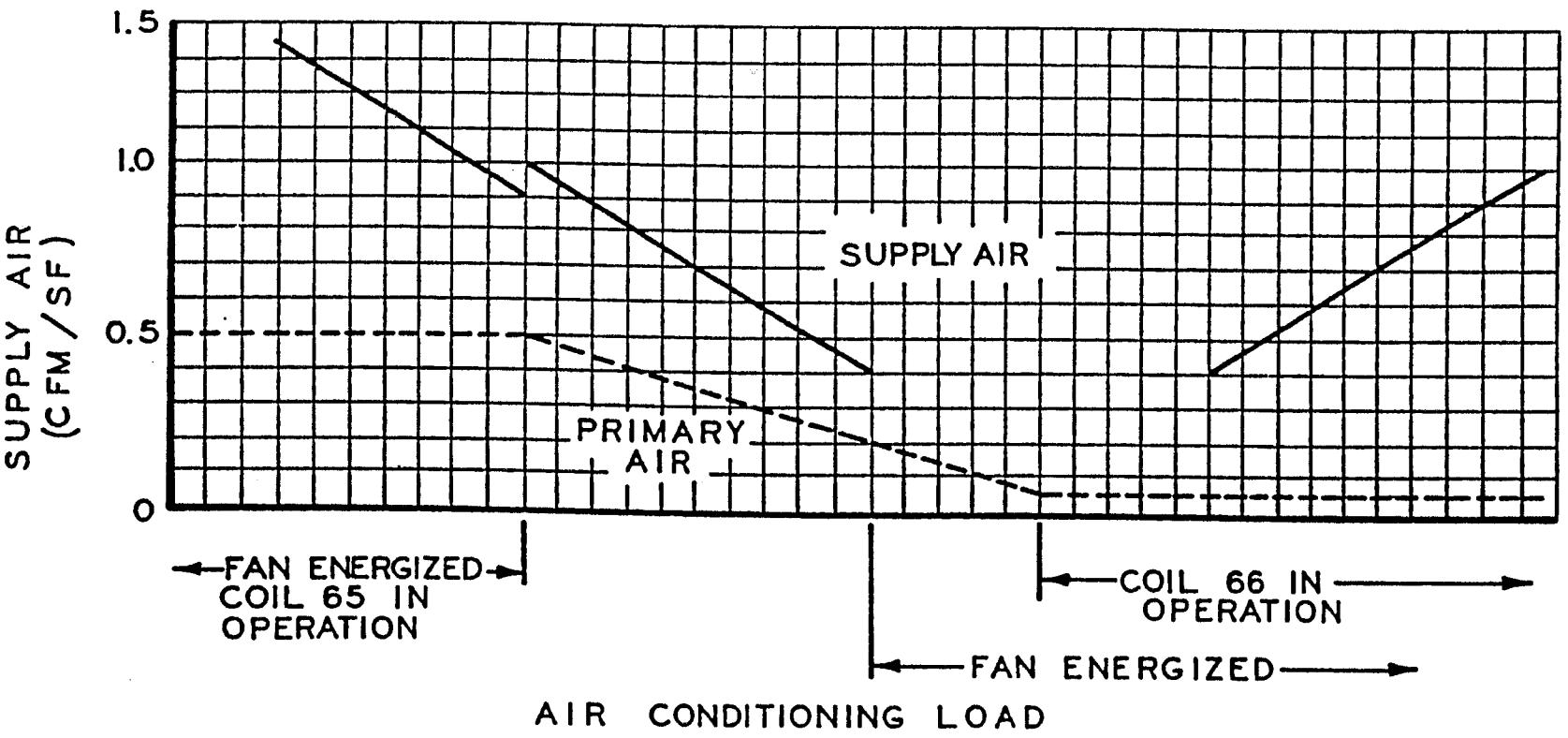
FIG. 14 is a graph showing rates of an air flow through the mixing box of FIGS. 12 and 13, when in operation, and the use of reheat and of supplemental cooling.

A desirable mode of operation of the mixing box 51*a* is shown graphically in FIG. 14.

It will be appreciated that the circulation of primary, conditioned air at a comparatively low dry bulb temperature of, for example, 50 degrees F. or even lower is economically advantageous. The size of fans, or risers, headers and ducts required for circulation of primary air is significantly reduced by comparison with systems where primary air at a substantially higher temperature is circulated. A condition of discomfort is avoided because, under all conditions of operation, a mixture of primary conditioned air with recirculted air is delivered to the space to be conditioned at a temperature, for example, of 62½ degrees F. or higher. However, primary, conditioned air at a dry bulb temperature 50 degrees F. is below the dew point even of a conditioned spaced maintained at 75 degrees F. dry bulb temperature and a relative humidity of 50 percent or more. Consequently, it is necessary for the riser, headers, ducts and the like of the air conditioning apparatus associated with a mixing box according to the invention to be thermally insulated to enable operation without condensation when a minimum quantity of low temperature primary, conditioned air is circulated.

It will be apparent that varies changes and modifications can be made in details of construction and operations from those shown in the attached drawings and discussed in conjunction therewith without departing from the spirit and scope of this invention as defined in the appended claims. It is, therefore, to be understood that the invention is not to be limited to the specific details shown and described.

I claim:

1. A mixing box having a primary air inlet, an air outlet, an induction nozzle between said primary air inlet and said air outlet, wherein primary air which flows into said primary air inlet, then flows through said induction nozzle and said air outlet, said induction nozzle being operable, when primary air flows therethrough at a sufficient rate, to indcue a flow of air from outside the mixing box for mixture with air discharged from said induction nozzle and delivery therewith through said mixing box outlet, means for controlling the rate of flow of primary air through said primar air inlet, a fan operable to induce a flow of air from outside the mixing box and to delivery such air through said mixing box outlet, means forming a closed passage for the flow of air from the exterior of the mixing box to the suction side of said fan and a control operable to energize and de-energize said fan.

2. A mixing box as claimed in claim 1 which additionally includes means operable to direct air discharge from said fan through said induction nozzle before it flows through said outlet.

3. A mixing box as claimed in claim 1 which additionally includes means operable by bypass air discharge from said fan around said induction nozzle and to said outlet.

4. A mixing box as claimed in claim 2 which additionally includes means for directing air from said primary air inlet to the suction side of said fan.

5. A mixing box as claimed in claim 3 which additionally includes a normally open damper ineffective when open and effective when closed to prevent the flow of air from outside the mixing box for mixture with air discharged from said induction nozzle, said damper being closed when said fan is energized.

6. A mixing box as claimed in claim 2 which additionally includes means for bypassing air discharged from said fan around said induction nozzle.

7. A mixing box as claimed in claim 2 which additionally includes a back draft damper effective to prevent the flow of air discharged from said fan through said induction nozzle to the suction side of said fan but ineffective to prevent the flow of air from the suction side of said fan to said induction nozzle.

8. A mixing box as claimed in claim 7 which additionally includes an opening through which air can flow between the suction side of said fan and the exterior of the mixing box, and a back draft damper effective to prevent the flow of air from the suction side of said fan through the opening to the exterior of the mixing box, but ineffective to prevent the flow of air from the exterior of the mixing box through the opening to the suction side of said fan.

9. A mixing box as claimed in claim 8 which additionally includes means for directing a part of the air discharged from said fan around said nozzle to said mixing box outlet.

10. A mixing box as claimed in claim 9 which additionally includes means for controlling the amount of air discharged from said fan that is directed around said nozzle.

11. A mixing box as claimed in claim 1 which additionally includes means for transferring heat to or from air which said fan induces to flow from outside the mixing box and delivers through said mixing box outlet.

12. A mixing box as claimed in claim 11 which additionally includes means operable to prevent the transfer of heat by said means for transferring heat to or from air which said fan induces to flow from outside the mixing box and delivers through said mixing box outlet except when said fan is energized.

13. A mixing box as claimed in claim 2 wherein said means operable to direct air discharged from said fan through said induction nozzle before it flows through said outlet is also operable to cause air discharged from said fan to mix with primary air before it flows through said induction nozzle.

14. A mixing box as claimed in claim 3 wherein said means operable to bypass air discharged from said fan around said induction nozzle and to said outlet is also operable to cause the bypassed air to mix with primary air discharged from said induction nozzle before it flows through said outlet.

15. A mixing box as claimed in claim 11 which additionally includes means for controlling the amount of heat transferred to or from air which said fan induces to flow from outside the mixing box and delivers through said mixing box outlet to maintain space temperature within control limits.

16. A mixing box as claimed in claim 12 which additionally includes means for controlling the amount of heat transferred to or from air which said fan induces to flow from outside the mixing box and delivers through said mixing box outlet to maintain space temperature within control limits.

17. In combination with an air conditioning system which includes means for circulating primary conditioned air to a space to be conditioned, a mixing box having a primary air inlet, means operably connecting said primary air inlet to receive primary conditioned air from said circulating means, an air outlet, an induction nozzle between said primary air inlet and said air outlet, wherein primary air which flows into said primary air inlet, then flows through said induction nozzle and said air outlet to the space, said induction nozzle being operable, when primary air flows therethrough at a sufficient rate, to induce a flow of air from outside the mixing box for mixture with air discharged from said induction nozzle and delivery therewith through said mixing box outlet to the space, means for controlling the rate at which primary air from said circulating means flows through said primary air inlet, a fan operable to induce a flow of air from outside the mixing box and to deliver such air to the space through said mixing box outlet, means forming a closed passage for the flow of air from the exterior of the mixing box to the suction side of said fan and a control operable to energize and de-energize said fan.

18. In combination with an air conditioning system which includes means for circulating primary conditioned air to a space to be conditioned, a mixing box as claimed in claim 17 in which said means for controlling the rate at which primary air from said circulating means flows through said primary air inlet is operable to vary the amount of primary conditioned air to maintain a desired comfort condition.

19. A mixing box as claimed in claim 1 in which said means for controlling the rate of flow of primary air through said primary air inlet is operable to vary the amount of primary conditioned air to maintain a desired comfort condition.

20. In combination with an air conditioning system which includes means for circulating primary conditioned air to a space to be conditioned, a mixing box as claimed in claim 17 which additionally includes means for transferring heat to or from air which said fan induces to flow from outside the mixing box and delivers through said mixing box outlet, and means operable to prevent the transfer of heat by said transferring means except when said fan is energized.

21. In combination with an air conditioning system which includes means for circulating primary conditioned air to a space to be conditioned, a mixing box as claimed in claim 20 which additionally includes means for controlling the amount of heat transferred to or from air which said fan induces to flow from outside the mixing box and delivers through said mixing box outlet to maintain space temperature within control limits.

22. In combination with an air conditioning system which includes means for circulating primary conditioned air to a space to be conditioned, a mixing box as claimed in claim 17 which additionally includes means for transferring heat to or from air which said fan induces to flow from outside the mixing box and delivers through said mixing box outlet.

23. In combination with an air conditioning system which includes means for circulating primary conditioned air to a space to be conditioned, a mixing box as claimed in claim 22 which additionally includes means for controlling the amount of heat transferred to or from air which said fan induces to flow from outside the mixing box and delivers through said mixing box outlet to maintain space temperature within control limits.

* * * * *